United States Patent [19]

Ueda et al.

[11] 4,222,356

[45] Sep. 16, 1980

[54] EXHAUST GAS RECIRCULATION FOR A DIESEL ENGINE

[75] Inventors: Takehito Ueda, Susono; Hiroshi Sami, Numazu, both of Japan

[73] Assignee: Toyota Jidosha Kogyo Kabushiki Kaisha, Toyota, Japan

[21] Appl. No.: 961,723

[22] Filed: Nov. 17, 1978

[30] Foreign Application Priority Data

Sep. 13, 1978 [JP] Japan ..... 53-111734

[51] Int. Cl.[3] ..... F02M 25/06

[52] U.S. Cl. ..... 123/568

[58] Field of Search ..... 123/119 A

[56] References Cited

U.S. PATENT DOCUMENTS

| | | | |
|---|---|---|---|
| 2,456,213 | 12/1948 | Pelc | 123/119 A |
| 3,918,421 | 11/1975 | Berry et al. | 123/122 H |
| 4,031,873 | 6/1977 | Banzhaf et al. | 123/119 A |
| 4,161,930 | 7/1979 | Bendig et al. | 123/122 H |

*Primary Examiner*—Wendell E. Burns
*Attorney, Agent, or Firm*—Kenyon & Kenyon

[57] ABSTRACT

Disclosed herein is an exhaust gas recirculation control valve for a diesel engine. The valve comprises a valve casing, disposed in the intake line of the engine, of a rectangular cross sectional shape. A valve seat connected to an exhaust line of the engine via an EGR passageway is formed in a side wall of the rectangular shaped valve casing. A valve member of a plate shape is arranged in the casing and is rotated about an axis located upstream of the valve seat in such a manner that the valve member is moved between a position wherein the plate closes the valve seat and another position wherein the plate closes the intake passageway. The valve device is operated by an actuator means including a vacuum actuator connected to the valve plate and a vacuum generator which transmits a vacuum signal into the actuator in accordance with the load of the engine.

3 Claims, 6 Drawing Figures

EXHAUST GAS RECIRCULATION FOR A DIESEL ENGINE

FIELD OF THE INVENTION

The present invention relates to an exhaust gas recirculation for a diesel type internal combustion engine.

In a diesel engine an excess amount of air is always introduced into combustion chambers of the engine. Therefore, an exhaust gas recirculation operation for a diesel engine is advantageously controlled when the excess air is replaced by recirculated exhaust gas. Since the amount of excess air decreases in accordance with the increase of the load of the engine, a type of control valve device is necessary such that, in accordance with an increase in the load of the engine, the amount of the recirculated exhaust gas introduced into the engine intake passageway decreases, while the amount of intake air directed to the engine increases. In order to effectively control the exhaust gas recirculation, a linear relation should be obtained between the opening of the control valve which corresponds to the load of the engine and the ratio of the amount of recirculated exhaust gas to the total amount of fluid directed to the engine (the so-called EGR ratio).

SUMMARY OF THE INVENTION

An object of the present invention is to provide a valve unit which is advantageously utilized in an exhaust gas recirculation system for a diesel engine.

Another object of the present invention is to provide a valve unit which can maintain a substantially linear relation between the degree of opening of the valve unit and value of EGR ratio.

Still another object of the present invention is to provide an exhaust gas recirculation system for a diesel engine, capable of controlling the EGR ratio in accordance with the load of the engine.

According to one aspect of the invention a valve device adapted to be used in an exhaust gas recirculation system for a diesel engine is provided. Said valve device comprises: a tubular casing defining a passageway of substantially rectangular cross sectional shape, through which intake air into the engine passes, said casing having, on one side wall thereof, an opening adapted to be connected to the exhaust gas recirculation system; a valve plate of substantially rectangular shape arranged in the casing; and, a valve shaft fixedly secured to one end of the valve plate so that the valve shaft is located transverse to the flow of the intake air, said shaft being rotatably mounted to the casing, the shaft substantially contacting the inner surface of said side wall at a position located upstream of said opening in such a manner that the valve plate can control the amount of exhaust gas introduced into the intake passageway.

According to another aspect of the invention an exhaust gas recirculation system for a diesel engine, which includes an engine body, an intake device having an intake passageway for introducing air into the engine body and an exhaust device having an exhaust passageway for receiving resultant exhaust gas from the engine body is provided. Said system comprises: an exhaust gas recirculation passageway connecting the exhaust device with the intake device, which passageway has an end opened to the intake passageways of substantially rectangular cross sectional shape; a valve member of substantially rectangular shape which is arranged in the intake passageway so that the valve member is pivoted about an axis located upstream of said end of the exhaust gas recirculation passageway, said axis being located adjacent to an inner surface of the intake passageway, and; actuation means responsive to the operating condition of the engine for imparting a pivot motion to said the valve member, in order to control the EGR ratio.

BRIEF DESCRIPTION OF ATTACHED DRAWINGS

DETAILED EXPLANATION OF PREFERRED EMBODIMENTS

Figure 1:
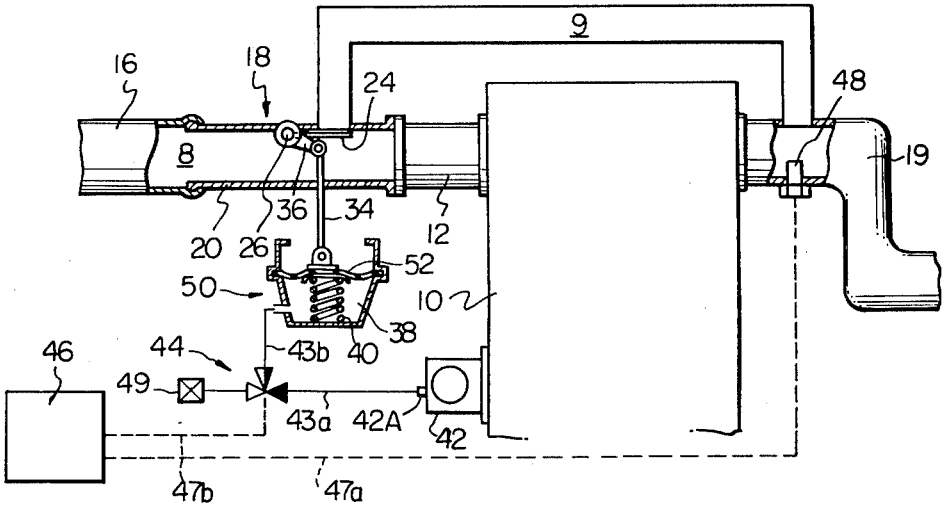
FIG. 1 is a schematic view of an exhaust gas recirculation system according to the present invention.

Referring to FIG. 1, a diesel engine includes an engine body 10 having combustion chambers therein with which an intake manifold 12 communicates. An intake pipe 16 is connected, on its upstream end, to a not shown air cleaner to receive air therefrom. The air is introduced, via an exhaust gas recirculation control valve device 18 of the present invention, which will be fully described later, into the intake manifold 12. An exhaust manifold 19 communicates with the combustion chambers for receiving the exhaust gas terefrom.

The control valve 18 includes a casing 20 which is, on one end thereof, connected to the pipe 16 and is on the other end thereof connected to the intake manifold 12. In the casing 20, the intake pipe 16 and the intake manifold 12, an intake passageway 8 is formed. The valve casing 20 is connected to the exhaust manifold 19 by way of an exhaust gas recirculation passageway 9. The valve 18 serves to control the amount of the exhaust gas introduced into the intake passageway 8 from the EGR passageway 9. The valve device 18 is provided with a valve element 24 of plate like shape which is arranged in the valve casing 20. The valve element 24 is connected, in a cantilever fashion, to a valve shaft 26 which is rotatably mounted to the casing 20 so that the shaft 26 is located upstream of the end of the EGR passageway 9 which is opened to the intake passageway 8. Therefore, the ratio of the amount of recirculated exhaust gas introduced into the intake passageway 8 to the amount of total fluid introduced into the engine (the so-called EGR ratio) is controlled by turning the valve plate 24 about an axis of the shaft 26.

Figure 2:
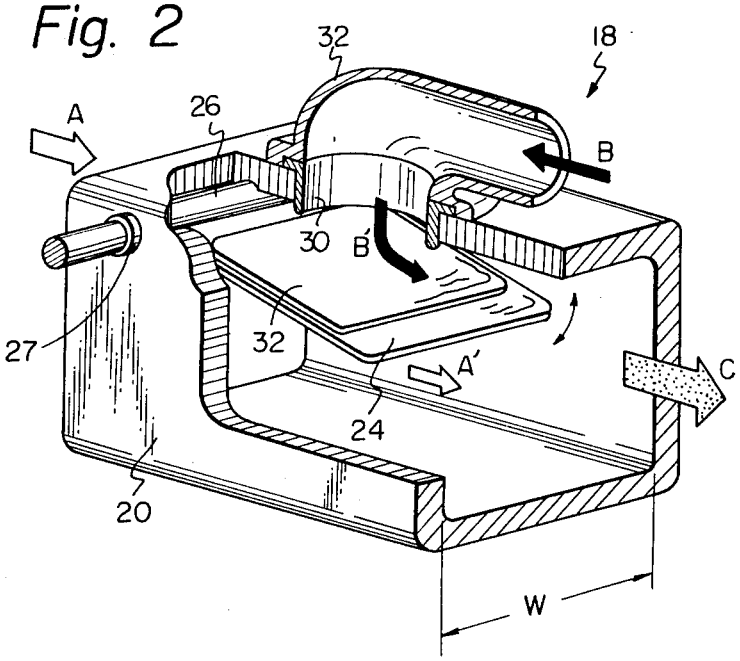
FIG. 2 is an enlarged perspective view of a valve device utilized in the system of FIG. 1.
Figure 3:
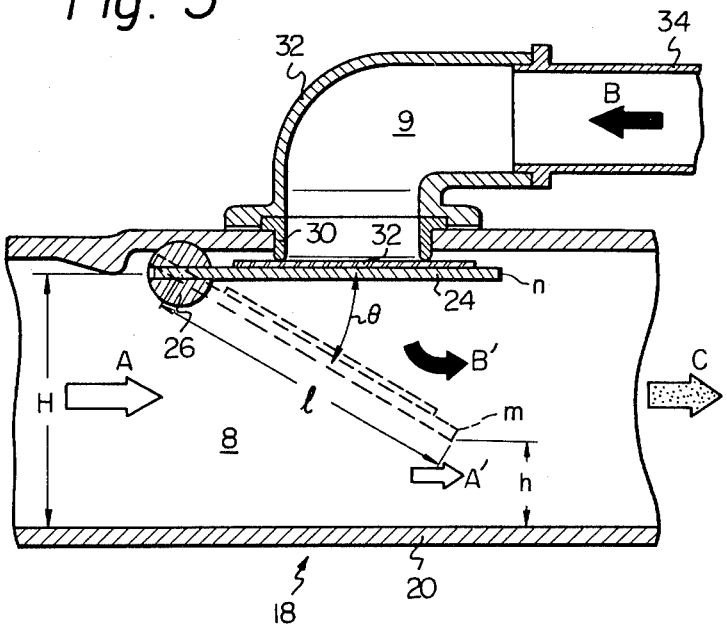
FIG. 3 is an enlarged longitudinal cross sectional view of the valve device in FIG. 1.

As shown in FIG. 2, which is a partially enlarged perspective view of FIG. 1, the casing 20 of the EGR control valve 18 is a tubular member of rectangular crossectional shape, in which the valve plate 24 of substantially rectangular shape is arranged. One end of the valve plate 24 is fixedly mounted to the valve shaft 26 which extends transverse to the flow of intake air in the intake passageway 8. The shaft 26 is rotatably mounted to opposite side walls of the rectangular casing 20 by respective bearing members 27 (one of which is shown in FIG. 2) in such a manner that the valve rod 26 substantially contacts an inner surface of an upper wall of the casing 20 adjacent said opposite side walls. To the upper side of the valve casing 20 a valve seat 30 of an annular shape is fixedly inserted. A coupling pipe 32 is connected to the annular valve seat 30, to which pipe 32 a hose 34 is connected as shown by FIG. 3. This hose 34 is connected to the exhaust manifold 19 (FIG. 1) by any suitable means which is well known to those skilled in this art. The valve member 30, the coupling member 32 and the hose 34 (in FIGS. 2 and 3) from therein the EGR passageway 9 in FIG. 1.

As shown in FIG. 2, the valve seat 30 is press-fitted to the casing 20 and, projects out of the inner surface of the casing 20 a small amount (a few mm). The valve plate 24 has, on one side thereof facing the projected end of the valve seat 30, a layer 32 of a seal member made of rubber material. Therefore, the seal member 32 of the valve plate 24 is sealingly positioned on the valve seat 30, when the valve 18 is in its closed position where the EGR passageway 9 is disconnected from the intake passageway 8 for stopping the EGR operation, as shown by a solid line n of FIG. 3.

The EGR system shown in FIG. 1 is further provided with a mechanism for controlling the amount of the recirculated exhaust gas in accordance with the load of the engine. The mechanism comprises a vacuum actuator 50 having a diaphragm 52 which is connected to, via a rod 34, one end of a lever 36. The other end of the lever 36 is fixedly mounted to an end of the valve shaft 26 projected out of the casing 20. On one side of the diaphragm 52 remote from the rod 34, a vacuum chamber 38 is formed, in which chamber 38 a spring 40 is arranged for urging the diaphragm 52 so that the valve plate 24 is turned in a counterclockwise direction. The mechanism is further provided with a vacuum signal generator for generating a vacuum signal transmitted into the chamber 38 of the actuator 50. The generator comprises a vacuum pump 42 operated by a not shown crankshaft of the engine. The intake port 42A of the pump 42 is connected, via a vacuum line **43*a*, a vacuum switching valve 44 and another vacuum line 43*b*, to the vacuum chamber 38 of the actuator 50. The vacuum switching valve 44 is an electro-magnetic valve operated by an electrical circuit 46 which receives an electrical signal transmitted, via an electrical line 47*a* from a sensor, 48 arranged in the exhaust manifold 19 for detecting the concentration of oxygen of the exhaust gas. Since the concentration of oxygen of the exhaust gas in the diesel engine corresponds to the load of the engine, the sensor 48 issues and electric signal indicating the load of the engine to the circuit 46. This circuit 46 provides an electric signal, which is transmitted to the switching valve 44 via another electrical line 47*b*, for selectively connecting the chamber 38 of the actuator 30 with the vacuum pump 42 or an atmospheric air pressure source 49, so that vacuum level in the chamber 38 is controlled in accordance with the load of the engine. Thus, the EGR ratio is controlled by the vacuum actuator 50** in accordance with the load of the engine as will be fully described later.

When the valve shift 26 is turned about the axis thereof in a clockwise direction in the drawings by a vacuum force generated under the diaphragm 52 of the vacuum actuator 50, the valve plate 24 is detached from the valve seat 30 as shown by FIG. 2. Intake air introduced into the valve casing 20 as shown by an arrow A passes through the valve plate 24 as shown by an arrow A'. Exhaust gas introduced into the coupling pipe 32 as shown by an arrow B passes through the valve plate 24 as shown by an arrow B''. The flow of intake air as shown by the arrow A'' and the flow of the exhaust gas as shown by the arrow B'' are mixed with each other and directed to the engine as shown by an arrow C. The more the valve shaft is turned in the clockwise direction of FIG. 2 for increasing the amount of exhaust gas introduced into the casing 20, as shown by the arrow B', the smaller the amount of the intake air, as shown by the arrow A'. Therefore, a large EGR ratio, which is the ratio of the amount of flow of exhaust gas as shown by the arrow B'' to the amount of the mixed flow as shown by the arrow C, is obtained even if the inner diameter of the EGR lines 30, 32 and 24 is relatively small. This feature of the valve 18 according to the present invention is very advantageous for an exhaust gas recirculation system of a diesel engine, since an EGR ratio as high as 50% is necessary during a low load condition of the engine.

The valve shaft 26 contacts an inner surface of a side wall of the rectangular shaped casing 20. Thus, the shaft 26 does not cause a substantial decrease in the amount of intake air passing through the casing 20, when the valve 18 is in its fully closed position, as shown by the solid line n in FIG. 3. Therefore, a large intake efficiency is obtained without utilizing a large size casing 20.

The relationship between the EGR ratio and the degree of opening of the valve plate 24, of the EGR control valve, according to the present invention, is now described.

It is assumed that the valve plate 24 is opened, as shown by dotted lines m in FIG. 3, from a fully closed position, as shown by the solid line n in FIG. 3. An effective flow area S of the intake air directed to the engine is inversely proportional to the degree of opening $\theta$ of the valve plate 24, as shown by a curve I in FIG. 4A, wherein $\theta$ is the angle between the closed position n and the open position m. The relationship between S and $\theta$ may be theoretically obtained by the following procedure. Firstly, S (the effective flow area of the intake air) is expressed by the following equation.

$$S = Wh \tag{1}$$

W: Width of the passageway in the casing 20, of the rectangular cross sectional shape.

h: height of the free end of the valve plate 24 opened as shown by the dotted line m, with respect to the inner bottom surface of the casing 20.

The height h is obtained by the following equation.

$$h = H - l \sin\theta \tag{2}$$

H: height of the rectangular passageway in the casing 20.

l: length of the valve plate 24.

By substituting the equation (2) for the equation (1), the following equation is obtained.

$$S = W(H - l \sin\theta) \tag{3}$$

This equation (3) means that the effective flow area S is inversely proportional to the degree of opening $\theta$ of the valve plate 24.

Figure 4A:
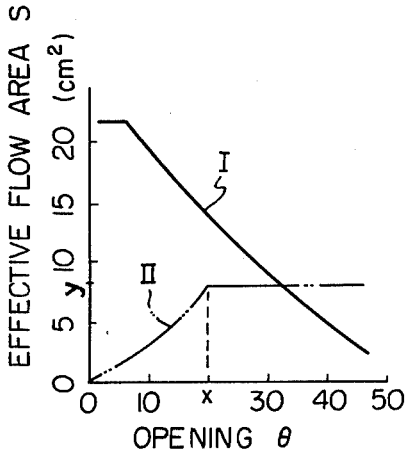
FIG. 4A is comprised of graphs showing the relationships between the opening of the valve device and the effective flow area.

An effective flow area S' of the recirculated exhaust gas is, as shown by a curve II of FIG. 4A, proportional to the degree of the opening $\theta$ when it is less than x degree. When the degree of opening $\theta$ is larger than x, the effective flow area is maintained at a predetermined constant value y, which corresponds to a minimum inner diameter of the EGR passageway 9 comprised of the valve seat 32, the coupling 32 and the hose 34.

The EGR ratio R is a ratio of the amount of the recirculated exhaust gas passed through the valve plate 24, as shown by the arrow B', to the amount of the combined flow directed to the engine, as shown by the arrow C. The amount of the recirculated exhaust gas corresponds to the effective flow area S' of the exhaust gas, while the amount of combined flow corresponds to the sum of the effective flow area S' of the recirculated gas and the effective flow area S of the intake air S. Therefore, the EGR ratio R is obtained by calculating a ratio of I to I+II with respect to every degree of opening $\theta$ of the valve plate 24. As is clear from the curve III in FIG. 4B, the relationship between the degree of opening of the valve plate 24 and the value of EGR ratio substantially conforms to a straight line IV, which is an idealized relationship between the EGR ratio R and the degree of opening $\theta$.

The reason the actual curve III does not coincide with the ideal curve IV resides in the fact that a difference of specific weight exists between the intake gas and the exhaust gas and that a difference of area exists between the intake passageway and the exhaust passageway. The dimension of the valve plate 24 and the valve seat 30 is properly selected so that a required curve III is obtained.

Figure 4B:
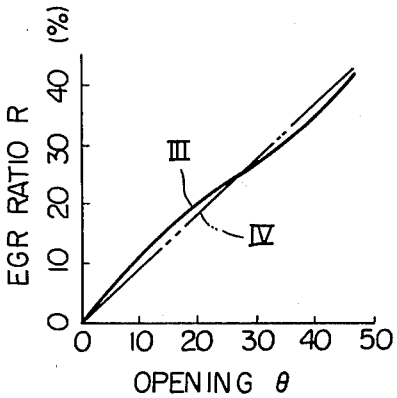
FIG. 4B is comprised of graphs showing the relationships between the opening of the valve plate and the EGR ratio.

Since a substantially linear relationship is obtained between the EGR ratio and the opening of the valve plate, as shown by the curve IV in FIG. 4B, according to the present invention, the vacuum actuator 50 can effectively control the EGR ratio in accordance with the load of the engine. Therefore, an idealized EGR operation is carried out for decreasing the amount of $NO_x$ emission from the diesel engine.

Figure 5:
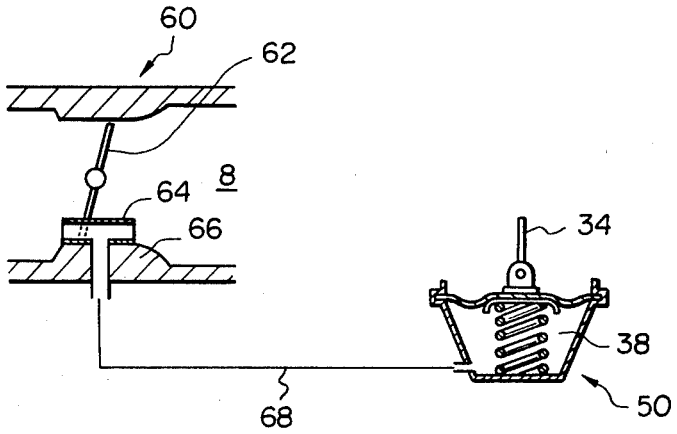
FIG. 5 illustrates another embodiment of a vacuum generating means.

In the embodiment shown in FIG. 1 the vacuum generator comprising the vacuum pump 42, the electromagnetic valve 44, the circuit and the sensor 48 is used. In place of this type of vacuum generator another type of vacuum generator can be used. In FIG. 5, to the chamber 38 of the actuator 50, a vacuum signal from a vacuum generator 60 is transmitted, which is utilized in a so-called pneumatic type governor mechanism of the diesel engine for controlling the opening of fuel injection valves in accordance with operating conditions of the engine. The actuator 60 has a throttle valve 62 located in the intake passageway 8 of the engine at a position located upstream of the EGR control valve of the invention, which is not shown in FIG. 5. A pipe piece 64 is arranged in a venturi portion 66 so that the pipe 64 passes through the throttle valve 62 when it is in the closed position, as shown by FIG. 5. The pipe piece 64 is connected to the chamber 38 of the actuator 50 via a vacuum line 68. The opening of the throttle valve 62 is controlled, by a not shown mechanism including an acceleration pedal, in accordance with the load of the engine. Therefore, a vacuum pressure, the level of which corresponds to the load of engine, is formed in the pipe 64. Thus a vacuum signal is transmitted to the chamber 38 of the actuator 50 via the vacuum pipe 68, and therefore, the actuator 50 can move the rod 34 connected to the valve plate 24, as shown in FIG. 1, so that the EGR ratio is controlled in accordance with the load of the engine.

While the embodiments of the invention have been described with reference to the appended drawings, many modifications and changes can be made thereto by those skilled in this art, without departing from the scope of the invention. What is claimed is:

1. An exhaust gas recirculating system for a diesel engine having a gas exhaust passageway connected with an exhaust gas recirculating passageway, and an air intake passageway having an exhaust gas recirculating control valve to which said recirculating passageway connects; said valve forming a straight passageway having a rectangular cross section and flat sides of which one side has an exhaust gas inlet opening to which said recirculating passageway connects, the valve's said straight passageway being connected in series with said air intake passageway and having a rectangular valve plate provided with means for pivoting one edge portion of the plate parallel to and adjacent to said one side and on the upstream side of said inlet opening so that the valve plate swings downstream so as to cover the inlet opening while opening said straight passageway and vice versa, the edges of said valve plate each being parallel to the adjacent one of said flat sides of the valve's said straight passageway and said valve having means for swinging said valve plate.

2. The system of claim 1 in which said means for pivoting the valve plate's said one edge portion is in the form of a rotative shaft positioned close to but beneath said one of the valve's straight passageway walls having said gas inlet opening, the gas inlet forming a valve seat extending beyond the surface of said one of the flat walls so as to permit the valve plate to swing to parallel engagement with the valve seat.

3. The system of claim 1 in which said means for swinging said valve plate comprises a vacuum actuated drive mechanically connected to swing the valve, and means for applying a vacuum to said drive automatically in response to the load on said engine.

* * * * *